US007719193B2

(12) United States Patent
Kikuchi et al.

(10) Patent No.: US 7,719,193 B2
(45) Date of Patent: May 18, 2010

(54) DISCHARGE LAMP CATHODE HAVING TIP, MIDDLE, AND BODY PORTIONS

(75) Inventors: Yasuro Kikuchi, Hyogo (JP); Kyosuke Fujina, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 135 days.

(21) Appl. No.: 12/010,787

(22) Filed: Jan. 30, 2008

(65) Prior Publication Data

US 2008/0185965 A1 Aug. 7, 2008

(30) Foreign Application Priority Data

Feb. 2, 2007 (JP) ..... 2007-023675

(51) Int. Cl.
*H01J 17/04* (2006.01)
*H01J 17/18* (2006.01)

(52) U.S. Cl. ..... 313/631; 313/331

(58) Field of Classification Search ..... 313/631, 313/578, 331, 332, 632, 326, 504–506; 445/23–25
See application file for complete search history.

(56) References Cited

U.S. PATENT DOCUMENTS

2005/0099121 A1 5/2005 Kikuchi et al.

FOREIGN PATENT DOCUMENTS

| | | | |
|---|---|---|---|
| JP | 02-304857 | A | 12/1990 |
| JP | 03-225741 | A | 10/1991 |
| JP | 10-283987 | A | 10/1998 |
| JP | 2002-50315 | A | 2/2002 |
| JP | 2005-142071 | A | 6/2005 |

OTHER PUBLICATIONS

Notice of Allowance (Japanese Patent Application No. 2007-023675) mailed on Feb. 24, 2009 (Japan).

*Primary Examiner*—Joseph L Williams
(74) *Attorney, Agent, or Firm*—Rader, Fishman & Grauer, PLLC

(57) ABSTRACT

A discharge lamp includes a cathode and an anode which face each other in an arc tube, wherein the cathode is made of tungsten in which thorium oxide is doped. The cathode has a cylindrical body portion, a tip portion having a cone shape, and a middle portion formed between the body portion and the tip portion, wherein an angle $\theta_1$ of the tip portion is set to a range of 55 degrees$\leqq\theta_1\leqq$65 degrees, and an angle $\theta_2$ formed by side faces of the middle portion is smaller than that of the tip portion.

2 Claims, 5 Drawing Sheets

| θ 1 (°) | Arc expansion and contraction | Light Intensity |
|---|---|---|
| 40 | × | ○ |
| 45 | × | ○ |
| 50 | × | ○ |
| 55 | ○ | ○ |
| 60 | ○ | ○ |
| 65 | ○ | ○ |
| 70 | ○ | × |
| 75 | ○ | × |

| A = 2mm | | | A = 3mm | | | A = 4mm | | | A = 5mm | | |
|---|---|---|---|---|---|---|---|---|---|---|---|
| $\theta_2$(°) | Time until Flicker is generated. (Time) | | $\theta_2$(°) | Time until Flicker is generated. (Time) | | $\theta_2$(°) | Time until Flicker is generated. (Time) | | $\theta_2$(°) | Time until Flicker is generated. (Time) | |
| 20 | 298 | × | 20 | 362 | × | 20 | 454 | × | 20 | 300 | × |
| 30 | 336 | × | 30 | 510 | O | 30 | 580 | O | 30 | 400 | × |
| 40 | 457 | × | 40 | 520 | O | 40 | 504 | O | 40 | 380 | × |
| 50 | 300 | × | 50 | 400 | × | 50 | 390 | × | 50 | 310 | × |

DISCHARGE LAMP CATHODE HAVING TIP, MIDDLE, AND BODY PORTIONS

CROSS-REFERENCES TO RELATED APPLICATION

This application claims priority from Japanese Patent Application Ser. No. 2006-023675 filed on Feb. 2, 2007, the contents of which are incorporated herein by reference in its entirety.

TECHNICAL FIELD

Described herein is a xenon lamp used as a light source in a projector in which, for example, DLP® technology (Digital Light Processing) may be used.

BACKGROUND

FIG. 6 shows the structure of a conventional discharge lamp, disclosed in Japanese Laid Open Patent No. 2005-142071.

This discharge lamp 1 comprises a bulb which is made of quartz glass, and has an arc tube 2 and sealed tube portions 3, and a cathode 4 and an anode 5. The cathode 4 and the anode 5 are provided so as to face each other in an arc tube 2 and are supported by respective electrode rods 6 made from tungsten. Moreover, support tube bodies 7 are fixed in the sealed tubes 3, respectively. Each of the support tube bodies 7 is cylindrical and is made from quartz glass and has a through hole therein, extending in the axis direction. While the electrode rods 6 are inserted in the respective support tube bodies 7 so that the rods are supported by the respective support tube bodies, the rods are attached in a way of sealing to the sealed tubes 3 by connection glass members 8. These electrode rods 6 extend outward from outer ends of the bulb, respectively, and serve as external lead rods from which electric power is supplied to the cathode 4 and the anode 5.

FIG. 7 shows the cathode 4 of the discharge lamp 1 which has such a structure. The cathode 4 is integrally made up of a cylindrical body portion 21, a tip portion 22 having a circular cone shape, and a step portion 23 having an outer circumference which is formed in the shape of steps between the body portion 21 and the tip portion 22. Moreover, the cathode 4 is made of tungsten in which thorium oxide is doped, and a layer of tungsten carbide is formed on the surface thereof. Since the cathode 4 becomes high temperature during lighting of the discharge lamp 1, thorium oxide is returned in the tungsten carbide layer, thereby becoming thorium, and the thorium stimulates electron emission from the cathode 4, so that the luminescent spot of an arc is stabilized. The temperature of the cathode 4 shown in FIG. 7 rises, when light of an arc is irradiated to a face 24 perpendicular to the central axis L of the step portion 23. Therefore, also in the step portion 23, a thorium oxide can be returned, so that thorium can be supplied, thereby increasing the quantity of thorium which can be used.

However, since elements of a digital projector are smaller in size, than those of the conventional film projector, the use efficiency of light decreases. Therefore, the discharge lamp 1 having high intensity is demanded as a light source. If an electric power input is increased to raise the intensity of the discharge lamp 1, expansion and contraction of the arc will occur. The intensity is related to the temperature of the tip of the cathode, in that the temperature of the tip portion 22 becomes high, as the intensity becomes high. Since the speed of evaporation of thorium will become high when the temperature of the tip portion 22 becomes high, the balance of demand and supply of thorium is disrupted. Therefore, the thorium is excessively consumed, so that thorium becomes insufficient, whereby expansion and contraction of an arc occurs. If expansion and contraction of an arc occurs, since an arc shakes, the luminescent spot moves. Since the position of the luminescent spot is not settled at a focal point within a condensing mirror if the luminescent spot moves so that an optical output fluctuates, flickering is generated when light is irradiated on a screen. Moreover, in order that expansion and contraction of an arc may not occur, it is conceivable that the cathode 4 and the anode 5 are arranged so that the distance therebetween may become long, thereby decreasing the temperature of the tip portion 22, or that the diameter at the tip of the tip portion 22 is enlarged, so that heat is dispersed, thereby making temperature per unit area low. However, if the distance of the cathode 4 and the anode 5 becomes long or the diameter at the tip of the tip portion 22 is enlarged, although expansion and contraction of an arc does not occur, since the light intensity decreases greatly, the light intensity of a light source may not be increased.

SUMMARY

Described herein is a discharge lamp having high intensity in which the luminescent spot of an arc is stabilized.

The present discharge lamp, comprising a cathode and an anode which face each other in an arc tube, wherein the cathode is made of tungsten in which thorium oxide is doped, wherein the cathode has a cylindrical body portion, a tip portion having a cone shape, and a middle portion formed between the body portion and the tip portion, and wherein an angle of the tip portion is 55 degrees or more and 65 degrees or less, and an angle formed by the meddle portion is smaller than that of the tip portion.

Also, in the discharge lamp, an axial direction length of the tip portion may be 3 mm or more but 4 mm or less, and an angle formed by side faces (ridge lines) of the middle portion may be 30 degrees or more but 40 degrees or less.

In such a discharge lamp according to an embodiment, the angle of a tip portion may be 55 degrees or more and 65 degrees or less. Thus, since the angle formed by the side faces of a middle portion is smaller than the angle of a tip portion, the luminescent spot of an arc can be stabilized in the high-intensity discharge lamp.

BRIEF DESCRIPTION OF THE DRAWINGS

Other features and advantages of the present discharge lamp will be apparent from the ensuing description, taken in conjunction with the accompanying drawings, in which.

DESCRIPTION

Figure 1:
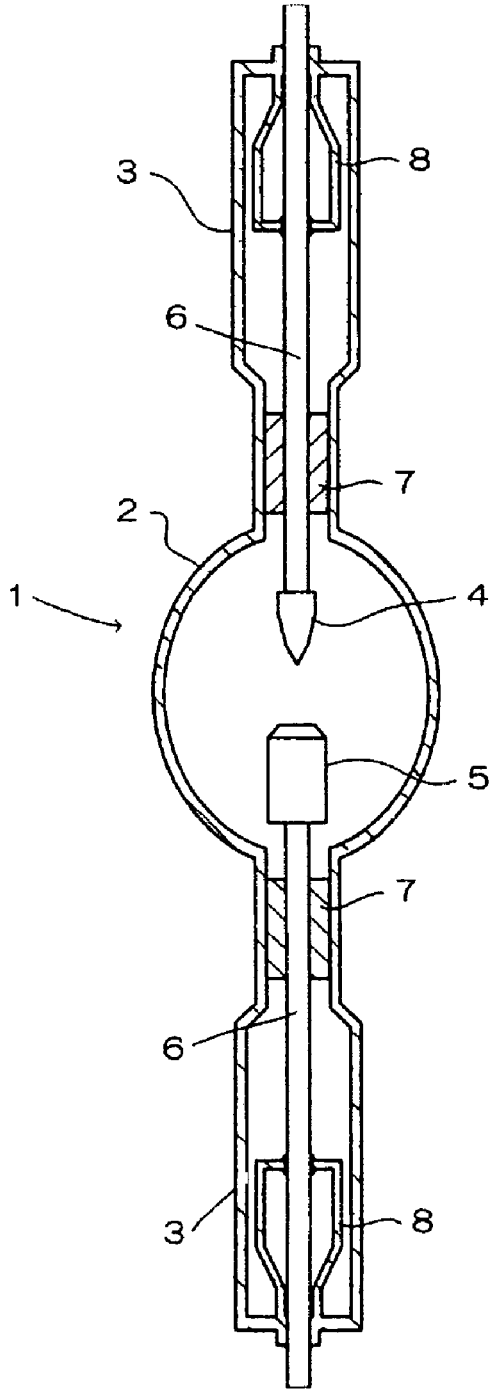
FIG. 1 is an explanatory cross sectional view showing the structure of a discharge lamp according to an embodiment.

A first embodiment is explained below. FIG. 1 is an explanatory cross sectional view of the structure of a discharge lamp 1 according to the embodiment. This discharge lamp 1 is made up of a bulb made of quartz glass. The bulb comprises an arc tube 2 and sealed tubes 3, a cathode 4 and an anode 5. The cathode 4 and the anode 5 are provided to face each other in the arc tube. Xenon gas is enclosed in the arc tube 2 whose shape is spherical, and the sealed tubes 3 are integrally formed continuously from respective ends of the arc tube 2. The anode 5 and the cathode 4 are inserted (attached) at the respective tips of tungsten electrode rods 6. Each of support tube bodies 7 made from quartz glass are arranged in a side of the arc tube 2 and inside the sealed tube 3. A through hole is formed in the center of each of the support tube bodies 7. The electrode rods 6 are inserted in the respective through holes, thereby supporting the anode 5 and the cathode 4. The diameter of portions of the sealed tubes 3 is contracted by heating the portions where the support tube bodies 7 are located, so as to form shrunk portions having a smaller diameter, whereby the electrode rods 6 are supported by the support tube bodies 7.

Thus, connection glass members 8 are arranged in the respective sealed tubes 3. One end of each connection glass member 8 is made of glass whose expansion coefficient is matched to that of quartz glass which forms the sealed tubes 3, and is welded with an end portion of the sealed tube 3. Another end of each connection glass member 8 is made of glass whose expansion coefficient is matched to that of tungsten which forms the electrode rod 6, and is attached to the electrode rod 6 by sealing. Moreover, a pair of electrode rods 6 is projected from the respective connection glass members 8 to the exterior of the respective sealed tubes 3, and the electric supply mechanism which is not illustrated is connected to these projected portions.

Figures 2, 3:
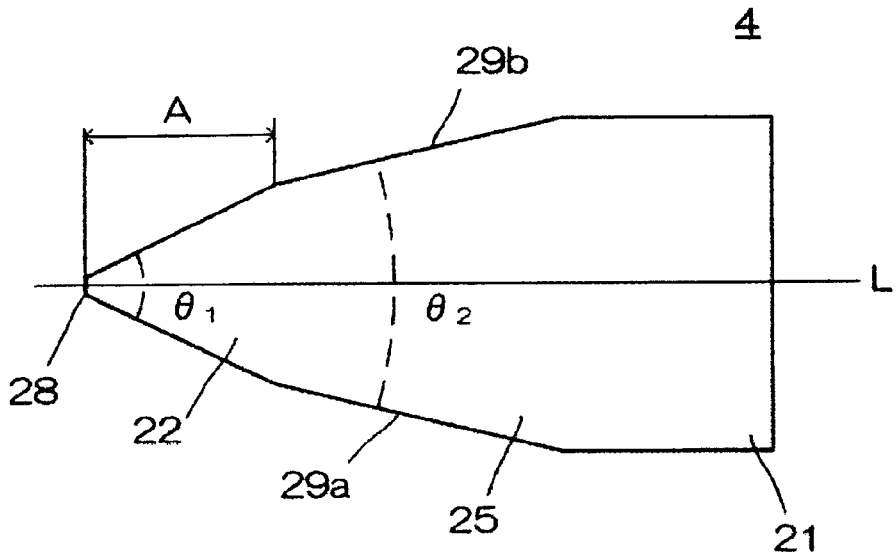
FIG. 2 is a cross sectional view showing a cathode of the discharge lamp according to an embodiment.
FIG. 3 is a table showing a measurement result of generation of expansion and contraction of an arc and the light intensity thereof.

FIG. 2 is a cross sectional view of the cathode 4 of the discharge lamp 1 according to an embodiment. The cathode 4 is integrally made up of a cylindrical body portion 21, a tip portion 22 having a circular cone shape, and a middle portion 25 which is formed between the body portion 21 and the tip portion 22. The outer circumference of the middle portion 25 is tapered, in which the diameter thereof becomes larger in a direction from the tip portion 22 to the body portion 21. In the cross sectional view taken along the axial direction of the cathode 4, a reference symbol "$\theta_1$", denotes an angle which is formed by ridge lines of the top part 28 of the tip portion 22, and a reference symbol "$\theta_2$" denotes an angle formed by side faces (or ridge lines) 29*a* and 29*b* of the middle portion 25. The angle $\theta_2$ formed by the side faces of the middle portion 25 is smaller than the angle $\theta_1$ of the tip portion 22. Moreover, a reference symbol "A" denotes a length from the apex of the tip portion 22 to an inflection point between the tip portion 22 and the middle portion 25 in a direction parallel to the axial direction L of the cathode 4. Moreover, all the body portion 21, the tip portion 22, and the middle portion 25 of the cathode 4 are made of tungsten in which thorium oxide is doped, and tungsten carbide is formed on the surface thereof. Since the cathode 4 becomes high temperature during lighting of the discharge lamp 1, a thorium oxide is returned in the tungsten carbide layer, thereby becoming thorium, and the thorium stimulates electron emission from the cathode 4, so that the luminescent spot of an arc is stabilized.

However, since the tip portion 22 becomes high temperature at the time of lighting when the angle $\theta_1$ of the tip portion 22 is too small, crystal grain of the tungsten grows thereby becoming large, and flow paths of the doped thorium oxide are closed, so that the thorium becomes deficient. If the thorium runs short, an arc will shrink and many electrons will be emitted. Since the temperature of the cathode 4 rises if an arc contracts, the amount of supply of the thorium temporarily supplied from the middle portion 25 increases, so that the arc expands. However, since the crystal grain of the tungsten of the tip portion 22 grows again, the thorium becomes insufficient.

Thus, when the angle $\theta_1$ of the tip portion 22 is small, expansion and contraction of the arc occurs. On the other hand, when the angle $\theta_1$ of the tip portion 22 is too large, since the temperature of the tip portion 22 at the time of lighting drops, expansion and contraction of the arc can be prevented, but there is a problem that the light intensity decreases.

FIG. 3 is a table showing the light intensity, and existence of expansion and contraction of the arc, which was measured when the angle $\theta_1$ of the tip portion was changed from 40 degrees to 75 degrees. The specification of the structure of this discharge lamp is shown below.

Cathode

Tungsten containing thorium oxides: 2% by weight

Distance from the tip of an anode: 3.5 mm

Diameter of a body portion: $\phi$10 mm

Angle formed by side faces (ridge lines) of a middle portion $\theta_2$: 40 degree Axial direction length of a tip portion: 3 mm Area of the tip of the tip portion: 0.3 $mm^2$ Discharge Lamp Enclosed xenon: 7.5 MPa Input: 4.2 kW The expansion and contraction of an arc repeatedly appears as rises and falls of lamp voltage, in which the voltage change is 0.2 V to 0.5 V. For example, a period of the voltage fall is one to five minutes, and after the voltage fall, the voltage rises and becomes stable for four minutes to 9 minutes, that is, a period of the cycle is five minutes to 10 minutes. A cycle of the voltage fall and the voltage rise is repeated for a couple of hours to several dozen hours. The reference symbol "x" was put down when occurrence of expansion and contraction of an arc was assumed when the cycle of the voltage rise and the voltage fall (the period of the cycle is 5 to 10 minutes) is repeated, and a reference symbol "○" was put down when the light intensity was 80000 lm or more. This result shows that expansion and contraction of an arc does not occur when the angle $\theta_1$ of the tip portion was 55 degrees or more. Moreover, when the angle $\theta_1$ of the tip portion was 65 degrees or less, the light intensity was sufficient. As mentioned above, if the angle $\theta_1$ of the tip portion was set to a range of 55 degrees to 65 degrees (55 degrees$\leqq\theta_1\leqq$65 degrees), and the angle $\theta_2$ formed by the side faces of the middle portion was set so as to be smaller than the angle $\theta_1$ of the tip portion, it turned out that in a discharge lamp with high intensity, the luminescent spot of an arc could be stabilized.

Figures 4, 5:
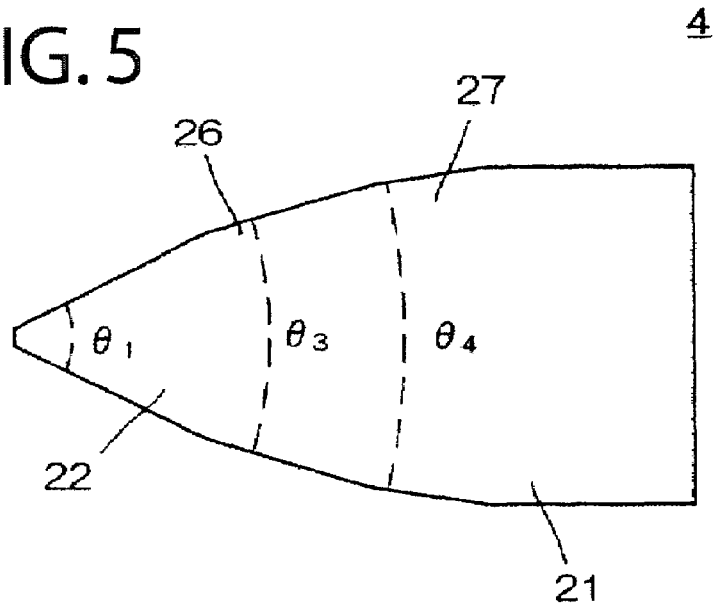
FIG. 4 is a table showing a measurement result of lighting time until a flicker occurs.
FIG. 5 is a cross sectional view showing a cathode of the discharge lamp according to an embodiment.
Figure 6:
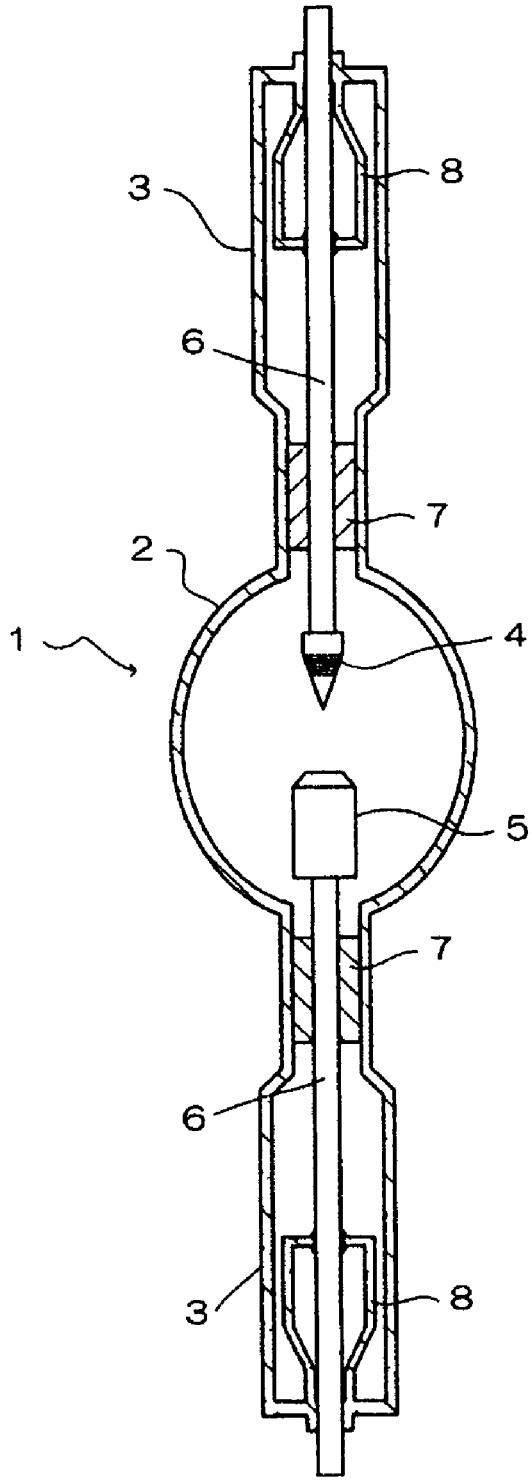
FIG. 6 is an explanatory cross sectional view showing the structure of a conventional discharge lamp.
Figure 7:
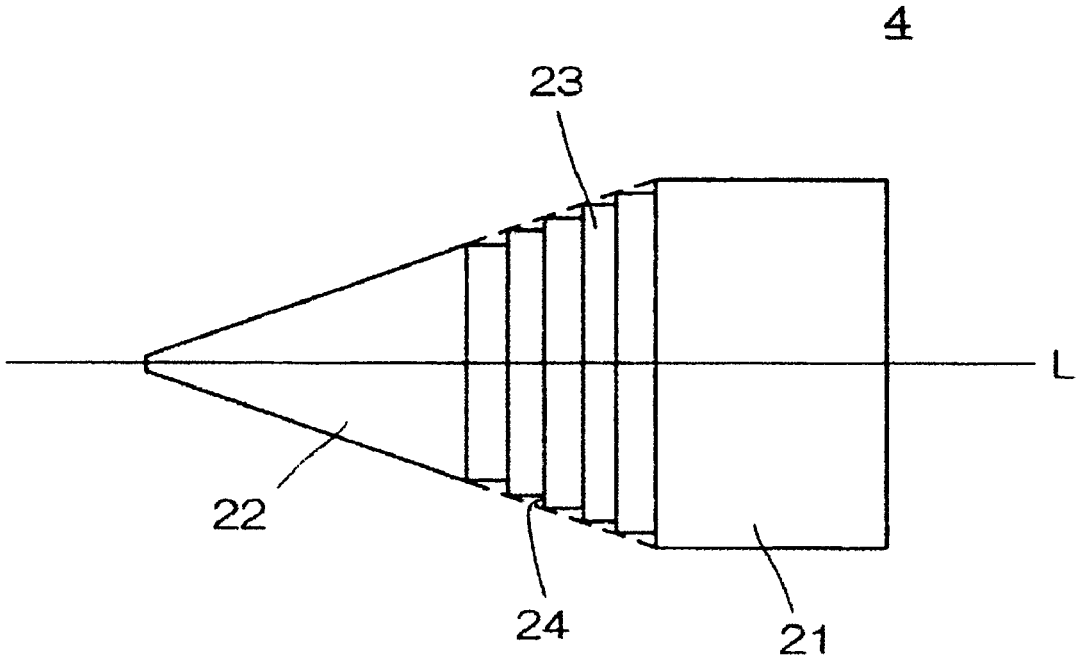
FIG. 7 is a cross sectional view showing a cathode of a conventional discharge lamp.

FIG. 4 is a table showing a lighting period from beginning of lighting to a time at which flicker is generated when changing an axial direction length A of the tip portion 22 shown in FIG. 2 from 2 mm to 5 mm, and changing the angle $\theta_2$ formed by the side faces of the middle portion 25 from 20 degrees to 50 degrees. If the quantity of thorium which evaporates from the tip portion 22 cannot be supplied from the middle portion 25 to the tip portion 22, the thorium becomes insufficient so that flicker may occur. That is, if the axial direction length A of the tip portion 22 is long and the angle $\theta_2$ formed by the side faces of the middle portion 25 is large, a difference in temperature between the tip portion 22 and the middle portion 25 will become large, and the temperature range in which diffusion of thorium may take place will become small. Accordingly, and thorium will be insufficient, so that a flicker will occur. When the axial direction length A of the tip portion 22 is short and the angle $\theta_2$ formed by the side faces of the middle portion 25 is small, a difference in temperature between the tip portion 22 and the middle portion 25 becomes small, and the temperature of the middle portion 25 becomes too high. Accordingly, the thorium is exhausted at an early stage, and the thorium is depleted, so that it is impossible to perform stable electron emission, thereby generating a flicker. Therefore, in order to control generation of a flicker, it is important to balance the demand of the thorium in the tip portion 22 and supply of the thorium from the middle portion 25. In order to supply sufficient quantity of thorium from the middle portion 25, while increasing an area which is at a temperature at which diffusion of thorium may take place inside the middle portion 25 and on the surface thereof, the axial direction length A of the tip portion 22, and the angle $\theta_2$ formed by the side faces of the middle portion 25 are appropriately set to a suitable value so that the temperature of the middle portion 25 may not become too high. The structure of the discharge lamp used for measurement is shown below.

Cathode

Tungsten containing thorium oxides: 2% by weight

Distance from the tip of an anode: 3.5 mm

Diameter of a body portion: $\phi$10 mm

Angle $\theta_1$ of the tip portion: 60 degree

Tip area of the tip portion: 0.3 $mm^2$

Discharge Lamp

Enclosed xenon: 5.0 Mpa

Input is 4.2 kW.

Flicker appears as change of the voltage impressed to the discharge lamp. It is assumed that flicker occurred, when the voltage impressed to the discharge lamp changes by 1.2 V or more, and the time from start of lighting to time of occurrence of the flicker was measured. Since it is not practical unless it is lighted with the arc of the stable luminescent spot for at least 500 hours or more, ○ was put down when lighting time until the flicker occurred was 500 hours or more, and x was put down when it is 500 hours or less. As a result, it turned out that when the axial direction length A of the tip portion was in a range of 3 mm or more but 4 mm or less (3 mm$\leqq$A$\leqq$4 mm), and the angle $\theta_2$ formed by the side faces of the middle portion was 30 degrees or more but 40 degrees or less (30 degrees$\leqq\theta_2\leqq$40 degrees), a period from the start of lighting to a time when a flicker occurred was 500 hours or more. Accordingly, when the axial direction length A of the tip portion was set to the range of 3 mm or more but 4 mm or less (3 mm$\leqq$A$\leqq$4 mm), and the angle $\theta_2$ formed by the side faces of the middle portion was set to the range of 30 degree or more but 40 degrees or less, the demand of the thorium at the tip portion 22 and supply of the thorium from the middle portion 25 was balanced, so that it was possible to offer a discharge lamp with high intensity in which the arc of the stable luminescent spot can be maintained for 500 hours or more.

A second embodiment of is explained. FIG. 5 is a cross sectional view showing a cathode 4 of a discharge lamp 1 according to the embodiment. The cathode 4 is integrally made up of a cylindrical body portion 21, a tip portion 22 having a circular cone shape, and a first middle portion 26 which is formed between the body portion 21 and the tip portion 22 and has an angle formed by side faces (ridge lines) thereof, smaller than that of the tip portion 22, and a second middle portion 27 which has an angle formed by side faces (ridge lines), smaller than that of the first middle portion 26. A connecting portion of the tip portion 22 and the first middle portion 26, a connecting portion of the first middle portion 26 and a second middle portion 27, and a connecting portion of the second middle portion 27 and the body portion 21 are smooth, that is they are connected without a step. Here, the axial direction length of the tip portion 22 is 3 mm, and the angle $\theta_1$ of the tip portion 22 is 60 degrees, the angle $\theta_3$ formed by the side faces of the first middle portion 26 is 40 degrees, and the angle $\theta_4$ formed by the side faces of the second middle portion 27 is 30 degrees. Since the angle (an inclination) of the second middle portion 27 is smaller than that of the first middle portion 26, it is possible to control the fall of the temperature thereof, and it is also possible to increase an area which is at a temperature at which diffusion of thorium may take place. In the discharge lamp having such a cathode 4, the demand of the thorium at the tip portion 22 and supply of the thorium from the middle portion 25 is balanced, so that it is possible to offer a discharge lamp with high intensity in which the arc of the stable luminescent spot can be maintained for 500 hours or more. Moreover, in the first embodiment, a portion between the tip portion 22 and the middle portion 25 and a portion of the middle portion 25 and the body portion 21 may be smoothly connected as in the second embodiment, that is they are connected without a step.

The preceding description has been presented only to illustrate and describe exemplary embodiments of the discharge lamp according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp, comprising a cathode and an anode which face each other in an arc tube, wherein the cathode is made of tungsten in which thorium oxide is doped, wherein the cathode has a cylindrical body portion, a tip portion having a cone shape, and a middle portion formed between the body portion and the tip portion, and wherein an angle $\theta_1$ formed by side faces of the tip portion is set to a range of 55 degrees$\leqq\theta_1\leqq$65 degrees, and an angle $\theta_2$ formed by side faces of the middle portion is smaller than that of the tip portion.

2. The discharge lamp according to claim 1, wherein an axial direction length A of the tip portion is set to a range of 3 mm$\leqq$A$\leqq$4 mm, and an angle $\theta_2$ formed by side faces of the middle portion is set to a range of 30 degrees$\leqq\theta_2\leqq$40 degrees.

* * * * *